United States Patent [19]

Meade

[11] 4,032,794

[45] June 28, 1977

[54] TELEVISION LOCKING MECHANISM

[76] Inventor: Robert P. Meade, 3419 42nd St., Metairie, La. 70001

[22] Filed: Sept. 19, 1975

[21] Appl. No.: 614,837

[52] U.S. Cl. ..... 307/326; 340/280

[51] Int. Cl.[2] ..... H01H 7/06

[58] Field of Search ..... 307/92, 94, 100, 126, 307/130, 140; 337/15, 16, 83, 1, 2, 3; 300/9 A, 13 C, 40 R, 154; 340/280

[56] References Cited

UNITED STATES PATENTS 3,974,492 8/1976 Girismen ..... 340/280

*Primary Examiner*—David Smith, Jr.

*Attorney, Agent, or Firm*—David L. Ray; Edgar E. Spielman, Jr.

[57] ABSTRACT

A locking mechanism for controlling the operational circuitry of the television or other electrical appliance whereby the duration of time during which the television or appliance may be disconnected from a voltage supply is limited to a pre-set period. Means are provided for energizing the locking mechanism after the appliance is connected to a voltage supply.

9 Claims, 2 Drawing Figures

TELEVISION LOCKING MECHANISM

Background of the Invention

This invention relates to a locking mechanism for preventing the theft of television sets or other electrical appliances. More particularly, the invention relates to a locking mechanism which prevents operation of a television set or other appliance after it has been disconnected from a voltage supply for a pre-set period of time.

The theft of television sets, radios and other electrical appliances presents a serious problem to businesses engaged in the leasing or rental of such appliances to the general public. It is not uncommon for a person who has rented or leased a television set to sell or otherwise dispose of the television set and to allege to the lessor that the set has been stolen or destroyed by someone other than the lessee.

The Invention

In accordance with the present invention there is provided a locking mechanism for controlling the operational circuitry of an electrical appliance such as a radio or television set whereby the duration of time during which the television may be disconnected from a voltage supply is limited to a pre-set period. Means are provided for energizing the locking mechanism after the appliance is connected to a voltage supply.

The invention will be more fully understood by reference to the drawings in which.

Figure 1:
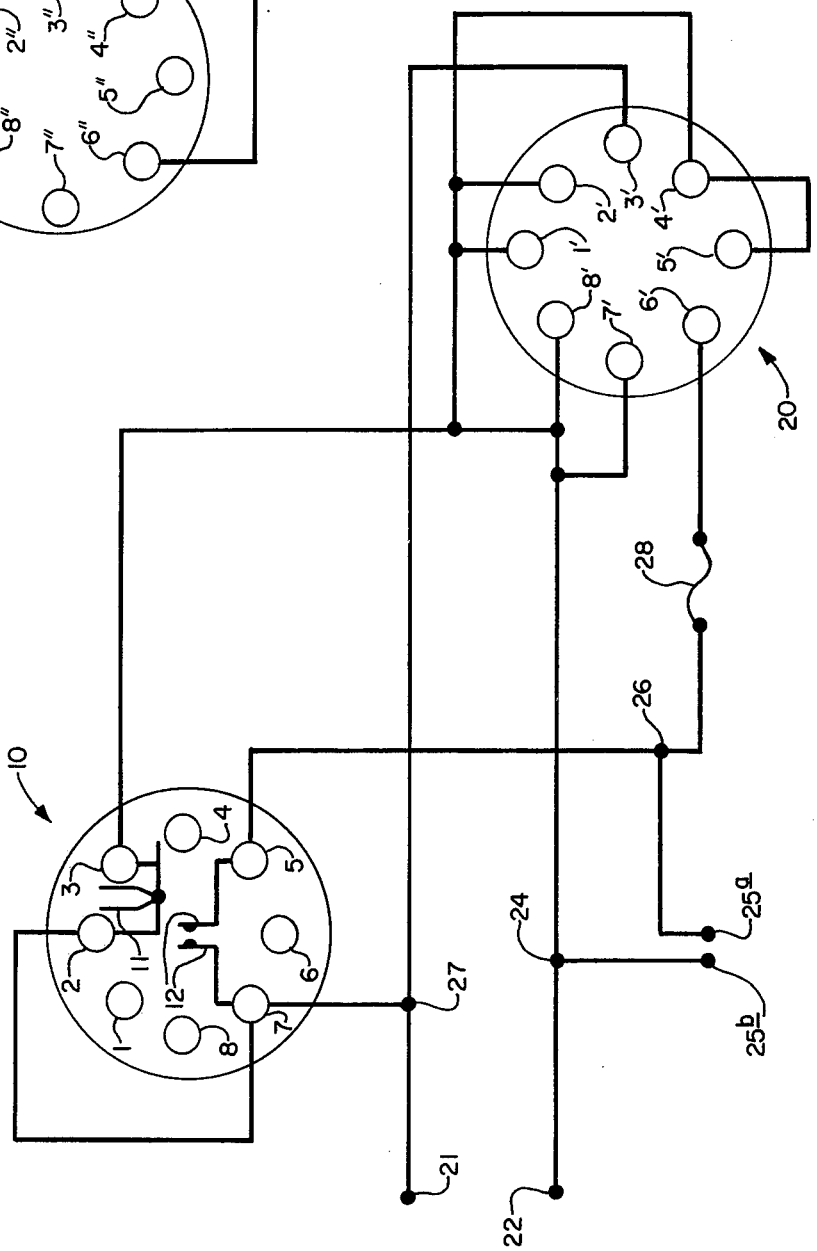
FIG. 1 is a schematic diagram of the circuit of the present invention.

Referring now to the drawings, in FIG. 1 is shown a time delay relay, generally indicated by the numeral 10, having eight posts thereon indicated by the numerals 1 through 8. Relay 10 has a heating element 11 connected to posts 2 and 3 and two contacts indicated by the numeral 12, one of the contacts being connected to post 5 and the other being connected to post 7. The contacts are thermally sensitive and close after thermal element 11 has been energized for a pre-set period of time, thereby electrically connecting post 5 to post 7.

Figure 2:
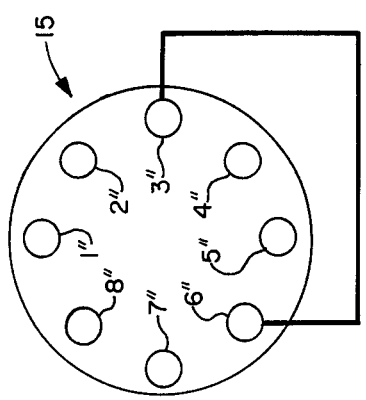
FIG. 2 is a schematic diagram of a plug of the present invention.

Also shown in FIG. 1 is receptacle 20 which has eight posts thereon numbered 1' through 8'. Each of the posts 1' through 8' has a female portion for receipt of a male plug, generally indicated by the numeral 15, which is shown in FIG. 2. Plug 15 and receptacle 20 are so constructed that each of the posts 1'' through 8'' of plug 15 mate with the correspondingly numbered receptacles 1' through 8' of receptacle 20. Also shown in FIG. 1 is a female plug receptacle 25 to which the television is plugged.

To operate the television set (or other appliance) an AC voltage is supplied across terminals 21 and 22 by, for example, plugging the mechanism into a wall socket. The voltage supply to the television set is supplied by plugging terminals **25*a* and 25*b* into a wall socket. No voltage is received by the television set because switch 12 is open and terminal 26 of plug 25 remains unenergized although terminal 24 of plug 25** is energized.

Plug 15 is then forced into receptacle 20. Plug 15 includes six non-connected posts, posts 1'', 2'', 4'', 5'', 7'' and 8'', and two posts, posts 3'' and 6'', which are electrically connected. Thus, when plug 15 is inserted into receptacle 20, post 6' and 3' of receptacle 20 are electrically connected, thereby applying a voltage to heating element 11 connected between posts 2 and 3, since post 2 of relay 10 is electrically connected to post 7 of relay 10, which is in turn electrically connected through terminal 27 to terminal 21. After the voltage is supplied to heater element 11 for a pre-set period of time, for example 20 seconds, the heat generated by heater element 11 will cause elements 12 to close thereby electrically connecting post 7 and post 5. Post 5 is electrically connected to terminal 26 and therefore the AC voltage supplied across terminals 21 and 22 is applied across terminals 24 and 26 to energize receptacle 25 and the television set connected thereto.

It is thus apparent that after the locking mechanism has been energized to supply a voltage to the television set, if the AC voltage across terminals 21 or 22 were removed for a period of time, for example 20 seconds, sufficient to cause switch contacts 12 to open, the television set would not function if the AC voltage across terminals 21 or 22 were re-supplied as by plugging the locking mechanism again into a power source. The television set could only be energized by inserting the plug 15 into receptacle 20 for a period of time sufficient to cause heating element 11 to actuate switch 12. Thus a lessor may deliver a television set to a home, plug the set in, insert plug 15 into relay 20, after plugging the television set into the locking mechanism, leave the key in for a sufficient period of time to actuate switch 12, remove the plug 15 and instruct the lessee that once the set is unplugged for more than 20 seconds, the set will cease to function without re-setting. Thus the lessee is detered from stealing the set since the set will not function if it is unplugged for more than 20 seconds.

A fuse 28 is connected between post 6' and terminal 26. The fuse is rated at approximately twice the amperage the appliance uses. This fuse would blow if any of the posts other than 3' were connected to post 6'.

The locking mechanism is preferably internally wired inside the television set, radio, or other appliance upon which it is used. Such placing of the mechanism inside the appliance helps deter anyone from tampering therewith.

What is claimed is:

1. A locking mechanism for an appliance including a cabinet housing operational circuitry responsive to electric power supplied on an input power cord from an external source, comprising means for preventing an electrical connection between said operational circuitry and said input power cord after said input power cord has been disconnected from an external power source for a pre-set period of time, including time delay relay means for providing an electrical connection between said operational circuitry and said input power cord for energization of said circuitry within a pre-set period of time after said input cord is connected to said external source, switch means connected to said time delay relay means for electrically connecting said external power source to said time delay relay means, and removable plug means adapted to activate said switch means.

2. The locking mechanism of claim 1 wherein said time delay relay means includes heating means which provides heat in response to an electric current and thermally sensitive relay means which closes when heated for a pre-set period of time by said heating means.

3. The locking mechanism of claim 1 wherein said switch means includes a series of terminals, at least two of which terminals, when electrically connected, electrically connect said time delay relay to said external power source.

4. The locking mechanism of claim 3 wherein said plug means includes a series of terminals equal in number to the terminals of said switch means and aligned for connection with the terminals of said switch means, two of said terminals of said plug means being electrically connected to electrically connect the two corresponding terminals of said switch means when said plug means is connected to said switch means.

5. The locking mechanism of claim 1 wherein said switch means has fuse means electrically connected thereto.

6. A locking mechanism for an appliance including a cabinet housing, said locking mechanism and operational circuitry responsive to electric power supplied on an input power cord from an external source, comprising means for preventing an electrical connection between said operational circuitry and said input power cord after said input power cord has been disconnected from an external power source for a pre-set period of time, including a. time delay relay means for providing an electrical connection between said operational circuitry and said input power cord for energization of said circuitry within a preset period of time after input cord is connected to said external source, said time delay relay means including heating means for providing heat in response to an electric current and thermally sensitive relay means which closes when heated for a pre-set period of time by said heating means, b. switch means connected to said time delay relay means for electrically connecting said external power source to said time delay relay means, and c. plug means adapted to activate said switch means.

7. The locking mechanism of claim 6 wherein said switch means includes a series of terminals, only two of which, when electrically connected, will permit said switch means to electrically connect said time delay relay to said external power source.

8. The locking mechanism of claim 7 wherein said plug means includes a series of terminals equal in number to the terminals of said switch means and aligned for connection with the terminals of said switch means, two of said terminals of said plug means being electrically connected to electrically connect the two corresponding terminals of said switch means when said plug means is connected to said switch means.

9. The locking mechanism of claim 8 wherein said switch means has fuse means electrically connected thereto.

* * * * *